US011536270B2

(12) United States Patent
Suzuki et al.

(10) Patent No.: US 11,536,270 B2
(45) Date of Patent: Dec. 27, 2022

(54) SCREW ROTOR AND SCREW-TYPE FLUID MACHINE MAIN BODY

(71) Applicant: Hitachi Industrial Equipment Systems Co., Ltd., Tokyo (JP)

(72) Inventors: Tomoo Suzuki, Tokyo (JP); Toshiaki Yabe, Tokyo (JP); Yuuji Itou, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 86 days.

(21) Appl. No.: 17/265,630

(22) PCT Filed: Jun. 7, 2019

(86) PCT No.: PCT/JP2019/022693
§ 371 (c)(1),
(2) Date: Feb. 3, 2021

(87) PCT Pub. No.: WO2020/044715
PCT Pub. Date: Mar. 5, 2020

(65) Prior Publication Data

US 2021/0301822 A1 Sep. 30, 2021

(30) Foreign Application Priority Data

Aug. 29, 2018 (JP) ..... JP2018-159882

(51) Int. Cl.
*F04C 18/16* (2006.01)
*F04C 29/00* (2006.01)

(52) U.S. Cl.
CPC ..... *F04C 18/16* (2013.01); *F04C 29/00* (2013.01); *F04C 2240/20* (2013.01); *F04C 2240/30* (2013.01); *F04C 2250/20* (2013.01)

(58) Field of Classification Search
CPC ..... F04C 18/02; F04C 18/08; F04C 18/082; F04C 18/084; F04C 18/16; F04C 2/16;
(Continued)

(56) References Cited

U.S. PATENT DOCUMENTS 5,310,320 A * 5/1994 Timuska ..... B30B 11/001 29/888.023
5,377,407 A * 1/1995 Takahashi ..... F04C 18/084 29/888.023

(Continued)

FOREIGN PATENT DOCUMENTS

CN 207377801 U 5/2018
JP 57-70985 A 5/1982

(Continued)

OTHER PUBLICATIONS

International Search Report (PCT/ISA/210) issued in PCT Application No. PCT/JP2019/022693 dated Sep. 3, 2019 with English translation (four (4) pages).

(Continued)

*Primary Examiner* — Audrey B. Walter
*Assistant Examiner* — Dapinder Singh
(74) *Attorney, Agent, or Firm* — Crowell & Moring LLP

(57) ABSTRACT

A screw rotor which is hollow has improved performance against heat, pressure, rust, and the like. A screw rotor includes a screw portion of which an outer periphery has teeth and grooves having a helical shape and extending by a predetermined length in an axial direction. A radial cross section of at least a part of the screw portion includes a cross section of an outer surface portion forming the teeth and the grooves, a cross section of an axial center portion, a cross section of a support portion that connects an axial center side of the outer surface portion and an outer diameter side of the axial center portion, and a cross section of a hollow portion (Continued)

formed by the support portions adjacent to each other in a rotational direction and an axial center side inner surface of a tooth bottom or a tooth tip. In at least the radial cross section of the screw portion, different members are continuously joined as an integral structure in a cross section of at least one of the axial center portion and the support portion and the outer surface portion.

12 Claims, 4 Drawing Sheets

(58) Field of Classification Search
CPC ..... F04C 2/18; F04C 2/20; F04C 2/14; F04C 2240/20; F04C 2240/30; F04C 2240/603; F04C 2250/20; F04C 29/00; F01C 21/08; F01C 1/14; F01C 1/16; F01C 1/18; F01C 1/20; F05C 2251/10; F05C 2251/042
See application file for complete search history.

(56) References Cited

U.S. PATENT DOCUMENTS

| | | | | |
|---|---|---|---|---|
| 6,158,996 | A | 12/2000 | Becher | |
| 2001/0031213 | A1 | 10/2001 | Liu et al. | |
| 2012/0045356 | A1 | 2/2012 | Nachtergaele et al. | |
| 2017/0058896 | A1* | 3/2017 | Collins | F04C 18/16 |

FOREIGN PATENT DOCUMENTS

| | | | |
|---|---|---|---|
| JP | 5-195701 | A | 8/1993 |
| JP | 5-506904 | A | 10/1993 |
| JP | 8-261183 | A | 10/1996 |
| JP | 8-284856 | A | 10/1996 |
| JP | 2577526 | Y2 | 7/1998 |
| JP | 2001-503119 | A | 3/2001 |
| JP | 2006-214366 | A | 8/2006 |
| JP | 2012-527556 | A | 11/2012 |
| JP | 2016-37901 | A | 3/2016 |
| JP | 2016-196859 | A | 11/2016 |

OTHER PUBLICATIONS

Japanese-language Written Opinion (PCT/ISA/237) issued in PCT Application No. PCT/JP2019/022693 dated Sep. 3, 2019 (four (4) pages).
Japanese-language Office Action issued in Japanese Application No. 2020-540079 dated Feb. 22, 2022 with English translation (six (6) pages).
Chinese-language Office Action issued in Chinese Application No. 201980048770.4 dated Mar. 11, 2022 (nine (9) pages).
Japanese-language Office Action issued in Japanese Application No. 2020-540079 dated Aug. 17, 2021 (2 pages).

* cited by examiner

SCREW ROTOR AND SCREW-TYPE FLUID MACHINE MAIN BODY

TECHNICAL FIELD

The present invention relates to a screw rotor and a screw-type fluid machine main body, particularly to a screw rotor including a hollow portion in the screw rotor and a screw-type fluid machine main body.

BACKGROUND ART

There are known screw-type fluid machines such as a screw-type compressor that compresses an intake gas to generate the compressed gas, a screw-type pump that pressurizes and transports an intake liquid, and a screw-type expander that expands an inflowing compressed gas to generate a rotational force.

For example, regarding the compressor, as positive displacement screw-type compressors, there are known a single screw-type compressor, a twin screw-type compressor, a triple (multiple) screw-type compressor, and the like in which teeth and grooves of a plurality of screw rotors rotating mesh with each other to reduce the volumes of compression working chambers to thus discharge a compressed gas (in the single screw-type compressor, a male or female rotor may be also referred to as a gate rotor). In addition, there are known various types of screw-type compressors such as a liquid-supply compressor that supplies a liquid such as water or oil to compression working chambers to compress an intake gas, and a liquid-free compressor that performs compression without having a supply of a liquid.

In the related art, as a structure of the screw rotor, there is disclosed a technique by which a hollow portion is provided inside the rotor. For example, in order to reduce the complexity or the man-hour of a production method for machining the teeth and grooves of a screw rotor by cutting or grinding from outside, Patent Document 1 discloses a method by which a non-machined member including a lobe member having an outer diameter smaller than the diameter of an inner diameter surface of a mold and having a hollow cylindrical shape, and a rotor shaft penetrating through the center of the lobe member in an axial direction is inserted into the mold which has a cylindrical shape and of which the inner diameter surface has the helical shape of an outer surface of the screw rotor in advance, and thereafter, a high-pressure gas is enclosed in a hollow portion via a shaft hole penetrating through the center of the rotor shaft in the axial direction and a through-hole penetrating through the rotor shaft in a radial direction such that the shaft hole and the hollow portion of the lobe member communicate with each other, so that an outer periphery of the lobe member is pressed against the inner diameter surface of the mold to obtain a screw rotor having a hollow inside and a helical outer periphery.

In addition, in order to further reduce the mass of the screw rotor which is hollow disclosed in Patent Document 1, Patent Document 2 discloses a screw rotor which is hollow, in which a shaft portion penetrating through a screw portion is not provided.

In addition, Patent Document 3 discloses a screw rotor including a hollow portion that is formed by stacking a plurality of steel plates in an axial direction. The document discloses that the steel plates each have a shape which is rotated by a predetermined angle around an axial center in the same rotational direction and are sequentially stacked to obtain the screw rotor having a helical outer shape. Then, it is disclosed that inner sides of portions corresponding to screw teeth of the steel plates each are punched out to obtain the steel plates having opening portions, and when the steel plates are stacked, the opening portions form a hollow portion having a helical shape.

In addition, in a screw rotor disclosed in Patent Documents 4 and 5, similarly to Patent Document 1, fluid pressure is applied to the inside of a cylindrical member having a hollow inside to press the cylindrical member against a mold having a helical inner wall to thus obtain a helical portion of teeth of the screw rotor, and thereafter, a hollow boss penetrating through an axial center of the helical portion, which is hollow, in an axial direction is inserted. Then, an outer periphery of the hollow boss is in contact with and fixed to the teeth of a hollow portion of the screw (hollow portion side of teeth bottoms), so that the strength of the screw rotor including the hollow portion is secured.

CITATION LIST

Patent Document

Patent Document 1: JP S57-70985 A
Patent Document 2: JP 2006-214366 A
Patent Document 3: JP H5-195701 A
Patent Document 4: JP H8-261183 A
Patent Document 5: JP H8-284856 A

SUMMARY OF THE INVENTION

Problems to be Solved by the Invention

By the way, when the screw-type fluid machine is a compressor, compression heat is generated by compression work of a gas, so that the temperature of the compressed discharge gas discharged from a compressor main body becomes high, and when the screw-type fluid machine is an expander, expansion heat is generated by expansion work of a gas, so that the temperature of the expanded discharge gas discharged from a compressor main body becomes low. Namely, heat generated by pressure fluctuation such as compression or expansion occurring in working chambers is required to be considered.

For example, the liquid-free screw-type compressor has a structure where a male rotor and a female rotor mesh with each other in a non-contact manner with a narrow gap therebetween to compress a gas, and unlike the liquid-supply type, a medium exchanging heat with the gas is not present in working chambers, and thus compression heat tends to have a higher temperature (approximately 300 to 350° C. in a single-stage compressor and approximately 160 to 250° C. in a multi-stage compressor) than that of the liquid-supply type. Since the compression heat causes thermal expansion of the rotors or a compressor main body casing that stores the rotors, in terms of maintenance, it is preferable that contact between the teeth of the rotors caused by the thermal expansion is avoided. As one example, in the compressor main body casing, a flow path of a cooling medium (water, coolant, oil, or the like) may be provided or a gap may be secured in consideration of thermal expansion in advance. Further, since the temperature of the compressed discharge gas is also high, generally, in many cases, a cooler that cools the compressed discharge gas is provided.

In addition, also in the liquid-supply screw-type compressor, the temperature of a compressed discharge gas tends to be lower than that of the liquid-free type, but may be approximately 100° C. to 120° C., and in many cases, a compressor main body casing may be provided with a flow path through which the cooling medium flows to cool a compressor main body or a cooler for the compressed discharge gas may be provided.

The rotor which is hollow disclosed in each of the above patent documents contributes to a reduction in mass of the rotor and the like, and is expected to have effects such as a reduction in driving energy, a reduction in weight, and a reduction in material cost; however, on the other hand, the rotor which is hollow receives a relatively higher thermal impact compared to the rotor that is hollow, which is a problem. For example, in the rotor which is hollow, the strength is relatively decreased, the impact of thermal expansion is increased, or the cooling performance of the compressed gas is decreased, which is a problem.

Such a thermal impact is a problem also for the case of the expander. For example, when the temperature of a high-pressure gas supplied to the working chambers is high, the heat resistance of the rotor against the heat or pressure is required to be considered. On the contrary, when the temperature of the expansion heat is low, it can be said that thermal shrinkage of the rotor is required to be considered.

A technique of maintaining and improving the performance of the screw-type fluid machine while taking the advantages of the rotor which is hollow is desired.

Solutions to Problems

For example, a configuration described in the claims is applied to solve the above problems. Namely, there is provided a screw rotor including: a screw portion of which an outer periphery has teeth and grooves having a helical shape and extending by a predetermined length in an axial direction. A radial cross section of at least a part of the screw portion includes a cross section of an outer surface portion forming the teeth and the grooves, a cross section of an axial center portion, a cross section of a support portion that connects an axial center side of the outer surface portion and an outer diameter side of the axial center portion, and a cross section of a hollow portion formed by the support portions adjacent to each other in a rotational direction and an axial center side inner surface of a tooth bottom or a tooth tip. In at least the radial cross section of the screw portion, different members are continuously joined as an integral structure in a cross section of at least one of the axial center portion and the support portion and the outer surface portion.

Effects of the Invention

According to the present invention, the rotor which is hollow can have improved performance against heat, pressure, rust, and the like.

Other problems, configurations, and effects of the present invention will be apparent from the following description.

MODE FOR CARRYING OUT THE INVENTION

Hereinafter, a mode for carrying out the present invention will be described with reference to the drawings.

Figure 1A:
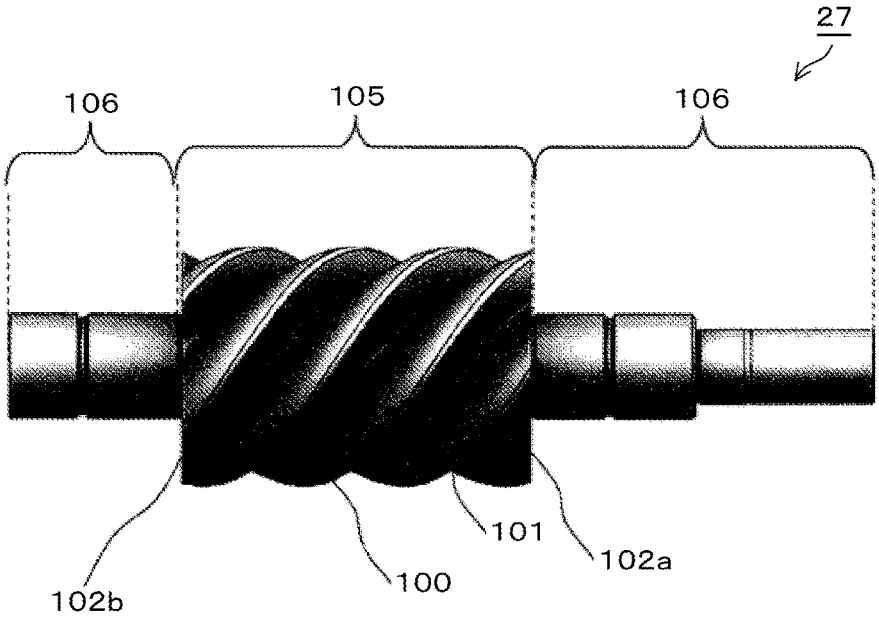
FIGS. 1A and 1B are axial side views illustrating a configuration of a screw rotor according to an embodiment to which the present invention is applied.
Figure 1B:
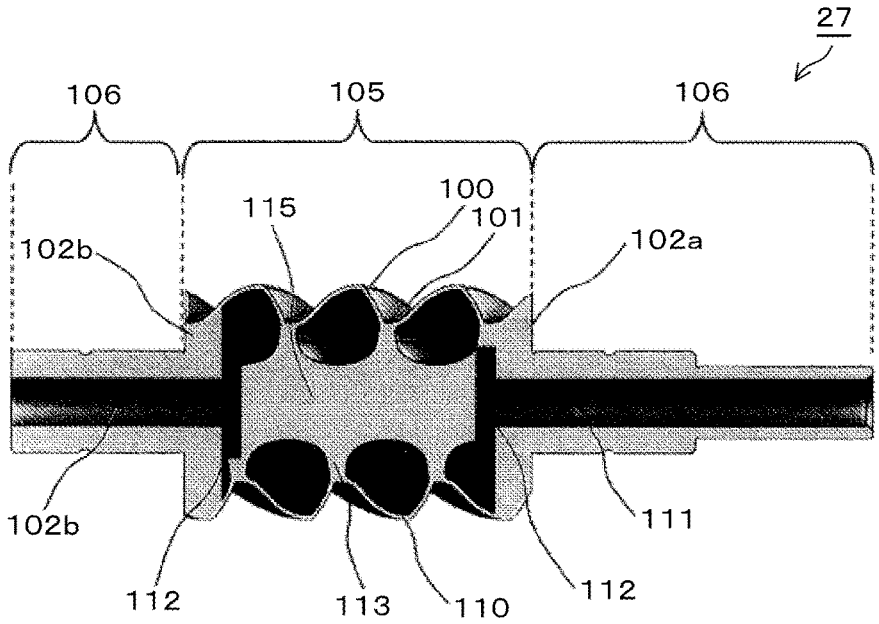

FIG. 1 schematically illustrates a configuration of a screw rotor in an embodiment to which the present invention is applied. FIG. 1(*a*) illustrates an axial side appearance of a male screw rotor 27, and FIG. 1(*b*) illustrates an axial longitudinal cross section of the male screw rotor 27. Incidentally, in the present embodiment, a male rotor of a twin screw rotor in which male and female rotors are paired will be provided as an example; however, the present invention is also applicable to a female rotor.

In FIG. 1(*a*), the male screw rotor 27 mainly includes a screw portion 105 including a tooth portion 100 and a groove portion 101 of which the radial outer peripheries have a helical shape and end portions 102*a* and 102*b* on both sides in an axial direction, and a shaft portion 106 disposed at the centers of the end portions in the axial direction of the screw portion 105.

The tooth portion 100 and the groove portion 101 mesh with tooth and groove portions of a female screw rotor 28 to be described later in a contact or non-contact manner, and a compression working chamber is formed by an inner wall of a bore of a casing main body 33*a* that stores the male screw rotor 27 and the female screw rotor. When the male screw rotor and the female screw rotor 28 rotate, the volume of the compression working chamber is contracted, so that a gas taken in from an intake side is discharged as a compressed gas.

The shaft portion 106 is disposed at the centers of the end portions in the axial direction of the screw portion 105. The shaft portion 106 receives rotational power from an electric motor 8, which is a drive source to be described later, to rotate the screw rotor.

In FIG. 1(*b*), the male screw rotor 27 includes a hollow portion 110 having a helical shape, a through-portion 111, and a communication portion 112 thereinside.

The hollow portion 110 is a cavity that forms a hollow portion in substantially the entirety of the screw portion 105 according to the shapes of teeth and grooves. In the present embodiment, the hollow portion 110 is provided for each tooth. The through-portion 111 is a flow path that penetrates through the center of the shaft portion 106 in the axial direction to transport a fluid to be described later to the screw portion 105. The communication portion 112 is a communication portion that allows the fluid to flow between both trailing ends in the axial direction of the hollow portion 110 and the through-portion 111.

Figure 2:
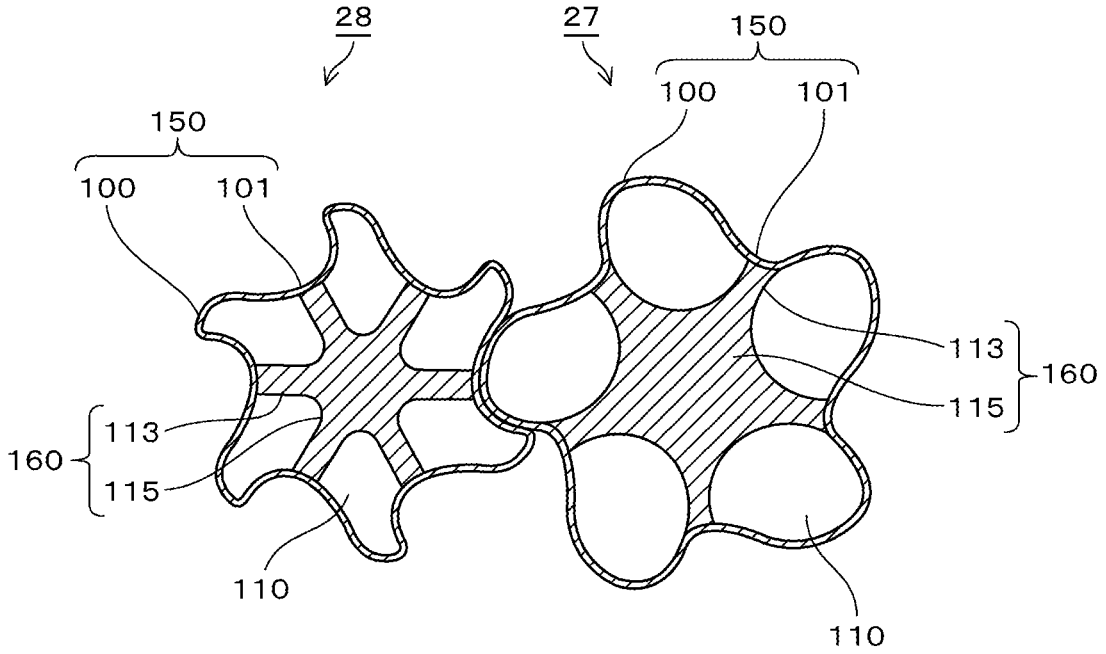
FIG. 2 is a view schematically illustrating a radial cross section of the screw rotor according to the present embodiment.

FIG. 2 schematically illustrates a radial cross section of the male screw rotor 27 and the female screw rotor 28. In the male screw rotor 27 as an example, the hollow portion 110 has a shape extending along the helical shape of the tooth portion 100 and the groove portion 101 in the axial direction. An axial center side of a bottom portion of the groove portion 101 is formed as a structure that is continuous with a support portion 113 extending from an axial center portion 115.

The tooth portion 100 and the groove portion 101 have a predetermined thickness in the axial direction, and the thickness is a thickness uniform in the axial direction. Accordingly, the cross section of the hollow portion has the same diameter (same area) in the axial direction. More specifically, the radial distance from an axial center side inner part of a tooth tip of the tooth portion 100 to the axial center portion 115 is the same as that of a hollow portion of another tooth and groove.

It is preferable that the thickness is made thin in terms of a reduction in mass of the rotor and an improvement in cooling efficiency of the rotor. However, the securing of the strength is important in terms of stress against pressure and durability against contact (including galling) between the rotor and another rotor or the inner wall of the bore of the casing.

Therefore, as one of features of the present embodiment, a lobe outer surface portion 150 including the tooth portion 100 and the groove portion 101 and a rotor inner part 160 including the support portion 113 and the axial center portion 115 are made of members having different characteristics, respectively. Namely, the lobe outer surface portion 150 which is relatively easily affected by compression stress or compression heat is made of a raw material having strength or heat resistance higher than that of the rotor inner part 160. For example, the lobe outer surface portion 150 is made of steel and the rotor inner part is made of aluminum. Further, in addition to a combination of metals, a combination of a metal and a resin, a combination of resins, or a combination of a metal and an alloy having the above relationship in heat resistance and hardness may be used.

Further, the member may be selected in terms of rust prevention. For example, the lobe outer surface portion 150 may be rusted by drainage generated in an internal space such as the compression working chamber. Therefore, the lobe outer surface portion 150 can be made of, for example, aluminum or resin having high rust prevention, and the lobe inner part 160 can be made of steel or the like.

As described above, the members forming the lobe outer surface portion 150 and the rotor inner part 160 are selected in consideration of heat resistance, hardness, rust prevention, and the like, and thus it is possible to improve the reliability or performance of the rotor while taking advantage of the rotor which is hollow.

Here, further, the present embodiment also has a characteristic that the lobe outer surface portion 150 and the lobe outer surface portion 160 are formed as a continuous and integral structure. The male screw rotor 27 and the female screw rotor 28 are fabricated by additive fabrication using a three-dimensional fabricating apparatus. As the additive fabrication, a stereolithography method, a powder sintering additive fabrication method, an ink jet method, a raw material melting additive method, a gypsum powder method, a sheet molding method, a film transfer imaging additive method, a metal stereolithography composite processing method, or the like can be applied. Further, an additive direction may be a horizontal direction, a vertical direction, or an oblique direction.

Electronic data for the above additive fabrication is generated by processing three-dimensional data into NC data using CAM, the three-dimensional data being generated by CAD or CG software or a three-dimensional scanner. The data is input into the three-dimensional fabricating apparatus or a cutting RP apparatus to perform three-dimensional fabrication. Incidentally, the NC data may be directly generated from the three-dimensional data by CAD and CAM software.

In addition, as a method for acquiring the three-dimensional data or the like, a data provider or servicer which creates the three-dimensional data or NC data can distribute the data in a predetermined file format via a communication line such as the Internet, and a user downloads the data to the three-dimensional fabricating apparatus, a computer controlling the three-dimensional fabricating apparatus, or the like or makes access to the data using a cloud service, so that the three-dimensional fabricating apparatus can perform molding for production. Incidentally, a method by which the data provider causes the three-dimensional data or NC data to be recorded in a non-volatile recording medium to provide the data to the user can be adopted.

According to the above method, the male screw rotor 27 (similarly, also the female screw rotor 28) can be made of the raw materials such that the lobe outer surface portion 150 (the tooth portion 100 and the groove portion 101) and the rotor inner part 160 (the support portion 113 and the axial center portion 115) are chemically joined to form a continuous and integral structure by the above various three-dimensional fabrication methods. Incidentally, in addition to the screw portion 105, the end portions 102*a* and 102*b* may be a part of the continuous and integral structure. Further, a configuration in which the end portion 102*a* is formed as a flat surface, which is not open in the axial direction, into the continuous and integral structure together with the screw portion 105 may be adopted. Alternatively, similarly, the end portions 102*a* and 102*b* or the shaft portion 106 may be also formed as a part of the continuous and integral structure.

It can be said that in cast forming, for example, the outer periphery of the screw portion 150 can be formed by a mold, but the disposition of a core is very complicated and further the removal of the core is very difficult or is not feasible, so that the continuous and integral formation of the above portions is very difficult.

In addition, for example, as disclosed in the patent documents at the beginning, when the male screw rotor 27 (similarly, also the female screw rotor 28) is formed as separate pieces by casting or cutting and the separate pieces are welded or bonded later, the man-hour is increased due to grinding of welded or bonded portions, or the like. In addition, it can be said that the uniform joining of the portions is difficult and there is also a strength problem.

In the screw rotor that is difficult to form in three dimension such as a helical shape, the present embodiment exhibits a remarkable effect of being able to provide a hollow body which can secure the strength or can improve the cooling performance and can efficiently use kinetic energy due to a reduction in mass.

Particularly, in addition to making the entirety in the axial direction of the screw portion 105 of a combination of the same members, the combination of the members in the axial direction can be also changed. For example, a discharge side is more affected by heat or pressure than the intake side. Therefore, it is feasible that only the discharge side of the lobe outer surface portion 150 of the screw portion 105 is made of a material having high resistance to heat or pressure and the remainder of the lobe outer surface portion 150 is made of the same material as that of the rotor inner part 160. As described above, in the present embodiment, even when the lobe outer surface portion 150 of at least a part of the radial cross section of the screw portion 105 extending in the axial direction and the rotor inner part 160 have different materials or characteristics, the effect can be exhibited.

Figure 3:
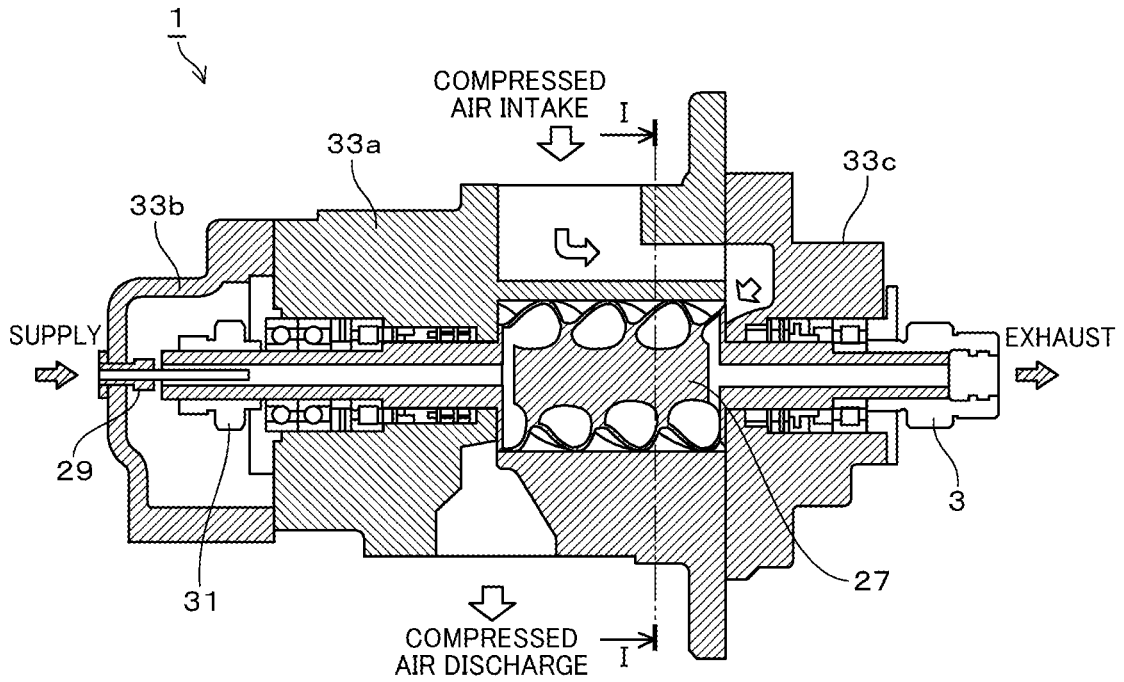
FIG. 3 is an axial longitudinal cross-sectional view of a compressor main body to which the screw rotor according to the present embodiment is applied.

FIG. 3 schematically illustrates an axial longitudinal cross-sectional view of a compressor main body 1 to which the male screw rotor 27 and the female screw rotor are applied. In addition, FIG. 4 schematically illustrates a configuration of a compressor 50 including the compressor main body 1.

The compressor main body 1 includes the male rotor 27, the female rotor 28, the casing main body 33*a* that accommodates the rotors 27 and 28 to form a plurality of the compression working chambers, and a discharge side casing 33*b* and an intake side casing 33*c* that store the shaft portion 106.

The casing main body 33*a* includes an intake port through which air is taken into the compression working chambers, and a discharge port through which compressed air generated in the compression working chambers is discharged. A pinion gear 3 is connected to a shaft end portion on the intake side of the male screw rotor 27 to be driven by the electric motor 8 which is a drive source, so that the male screw rotor 27 and the female screw rotor 28 rotate. A structure where timing gears 31 and 32 are connected to shaft end portions on the discharge side of the rotors 27 and 28 and the rotation of the male screw rotor 27 is transmitted to the female screw rotor 28 by the connection to cause the rotors 27 and 28 to rotate synchronously is adopted. Due to the rotation, while the compression working chambers move to the discharge side, the compression working chambers are reduced in volume to compress the air.

Figure 4:
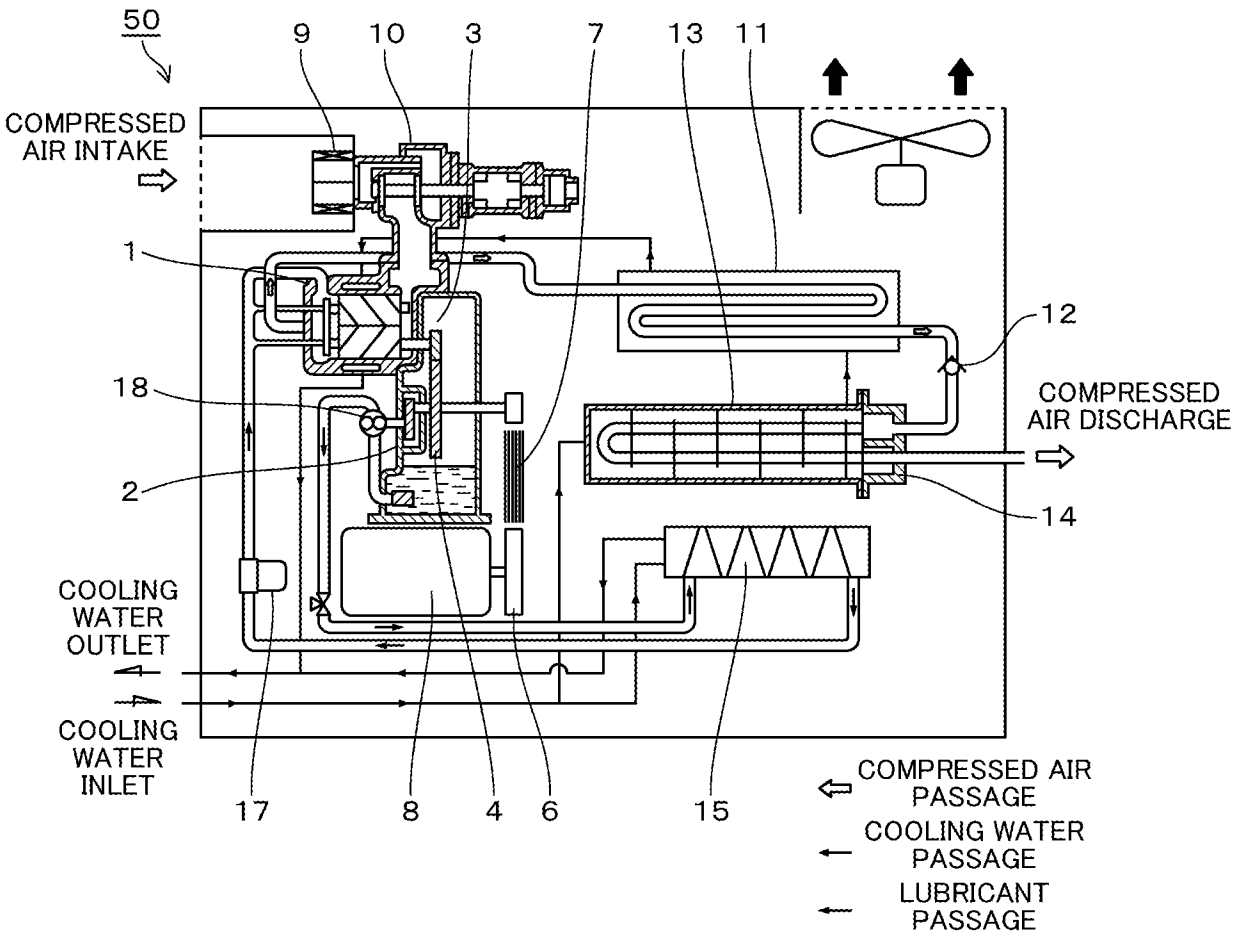
FIG. 4 is a schematic view illustrating a configuration of an air compressor to which the screw rotor according to the present embodiment is applied.

In FIG. 4, the pinion gear 3 connected to the shaft end portion of the male screw rotor 27 meshes with a bull gear 4 attached to one side of an intermediate shaft in a gear casing 2. A pulley 5 is attached to the other side of the intermediate shaft, and a belt 7 which is a transmitter of a driving force is mounted around the pulley 5. The belt 7 is also mounted around a pulley 6 attached to a shaft end of the electric motor 8 to transmit the power of the electric motor 8 to the compressor main body 1. Incidentally, as another configuration of a drive mechanism, a gear and a chain other than a combination of the pulley 6 and the belt 7 may be used, or the rotor shaft may be directly connected to an output shaft of the electric motor 8.

An intake throttle valve 10 which regulates the amount of air to be taken into the compressor main body 1 is disposed on an intake side of the compressor main body 1. The air is removed of foreign matter by an intake filter 9 to pass through the intake throttle valve 10 to be taken into the compressor main body 1, and the air is compressed to a predetermined pressure to be discharged from an outlet of the compressor main body. The compressed air discharged from the compressor main body 1 is cooled by a water-cooled precooler 11 provided downstream of the compressor main body 1, and is then guided to a water-cooled aftercooler 13 via a check valve 12. The compressed air cooled by the aftercooler 13 is discharged from a compressed air outlet. Here, an air passage in the aftercooler 13 is made of a U-shape pipe, and an inlet and an outlet of the pipe are formed as integral cooler headers 14.

In the compressor 50, a lubricant is used as a cooling medium to lubricate a sliding body and the like. The passage of the lubricant is as follows. The lubricant circulates in such a manner that after the lubricant stored in an oil reservoir provided in a lower portion of the gear casing 2 is guided to an oil cooler 11 by an oil pump 16 to be cooled and to be removed of contaminant or the like by an oil filter 17, the lubricant is supplied to bearing members, the timing gears 31 and 32, the pinion gear 3 of the compressor main body 1 and to bearing members of the intermediate shaft or the bull gear 4 attached to the intermediate shaft in the gear casing 2 to then return to the oil reservoir of the gear casing 2. The lubricant flows from a male screw rotor nozzle 29 (and a female screw rotor nozzle 30) attached to the compressor main body 1 into the hollow portion 110 via the through-portion 111 and the communication portion 112 of the rotors 27 and 28 to be used for cooling. The lubricant circulates in such a manner that after the lubricant has cooled the rotors 27 and 28, the lubricant passes through the pinion gear 3, similarly to the other lubricant, to be stored in the oil reservoir in the gear casing 2. Incidentally, since the lubricant flows into the intake side from the discharge side on which temperature is high, higher cooling performance can be obtained; however, the lubricant may flow into the discharge side from the intake side.

As described above, according to the present embodiment, the male screw rotor 27 and the female screw rotor 28 are a combination of members forming the rotors, which are made to differ from each other according to characteristics; and thereby, while the rotors are reduced in mass, the strength, the heat resistance, the rust prevention, and the like can be improved, and rotational energy reduction effect and durability can be secured.

Further, since the cooling medium flows through the hollow portion 11, a rise in temperature of the screw rotor can be reduced. Since the improvement in cooling performance suppresses thermal deformation of the male screw rotor 27 and the female screw rotor 28, gaps between the screw rotors and between the screw rotors and the inner wall of the bore of the casing main body 33*a* can be reduced; and thereby, compression performance can be improved.

In addition, since the thermal deformation of the screw rotors is suppressed, a variation in accuracy of machining the tooth portion or a variation in compression performance occurring during low load operation can be also reduced. Further, since discharge air temperature can be also reduced, the coolers in the compressor can be reduced or eliminated; and thereby, the cost can be reduced and the entirety of the compressor can be compacted.

In addition, since the screw rotors 27 and 28 each are formed by the three-dimensional fabricating apparatus, a complicated structure including the hollow portion 110 having a helical shape, the communication portion 112, and the end portions 102*a* and 102*b* can be formed of a member having partially different characteristics.

The modes for carrying out the present invention have been described above; however, the present invention is not limited to the above various embodiments, and various modifications or substitutions can be made without departing from the concept of the present invention. For example, in the above embodiment, all the screw rotors forming the compressor main body 1 have a hollow shape, and the lobe outer surface portion 150 and the rotor inner part 160 are fabricated with different members to form both the rotors; however, only one of the screw rotors may have a hollow shape and be a combination of different members.

In addition, even when the male and female screw rotors each have a hollow shape, combinations of members can be not the same, and different combinations of members can be also applied.

In addition, in the above embodiment, the male screw rotor 27 includes five teeth and the female screw rotor 28 includes six teeth; however, the number of the teeth can be randomly changed depending on application.

In addition, in the above embodiment, the compressor main body 1 is provided in one compressor as an example; however, the present invention may be applied to a compressor having a multi-stage configuration having two or more stages. For example, a two-stage compressor including a low-pressure stage compressor main body and a high-pressure stage compressor main body may have a configuration in which the above rotors which are hollow and are made of members having different characteristics are applied to all or a part of rotors of a low-pressure stage and a high-pressure stage. An intake side of the high-pressure stage compressor main body has temperature and pressure higher than those of an intake side of the low-pressure stage compressor main body. Further, intermediate drainage increases the risk of rust. Therefore, a material having higher strength, heat resistance, and rust prevention is applied to the lobe outer surface portion 150 of the screw rotor of the high-pressure stage compressor main body, and the rotor which is hollow and has high reliability corresponding to problems of each of the stages can be applied.

In addition, in the above embodiment, the air compressor has been provided as an example of the fluid machine; however, the present invention can be applied to an expander using screw rotors or a pump device (liquid pressure feeder) using screw rotors or rotary blades. In addition, the compressor is not limited to compressing air, and the compressor may compress other gases. In addition, the oil-free screw-type compressor has been provided as an example; however, the liquid to be supplied to the compression working chambers may be not only oil but also water or other liquids. In addition, the present invention can be also applied to a liquid-supply screw-type compressor.

In addition, in the above embodiment, the electric motor has been described as a drive source; however, the drive source may be, for example, an internal combustion engine or other devices that generate a rotational force. Particularly, when the present invention is used in an expander, the expander may be configured to include a generator instead of the electric motor or to use the electric motor as a motor generator.

REFERENCE SIGNS LIST

1 Compressor main body
2 Gear casing
3 Pinion gear
4 Bull gear
6 Pulley
7 Belt
8 Electric motor
9 Intake filter
10 Intake throttle valve
11 Precooler
12 Check valve
13 Aftercooler
14 Aftercooler header
15 Oil cooler
16 Oil pump
17 Oil filter
27 Male screw rotor
28 Female screw rotor
29 Male screw rotor nozzle
30 Female screw rotor nozzle
31 Timing gear for male screw rotor
32 Timing gear for female screw rotor
33*a* Casing main body
33*b* Discharge side casing
33*c* Intake side casing
50 Screw-type compressor
100 Tooth portion
101 Groove portion
102*a*, 102*b* End portion
105 Screw portion
106 Shaft portion
110 Hollow portion
111 Through-portion
112 Communication portion
113 Support portion
115 Axial center portion
150 Lobe outer surface portion
160 Rotor inner part

The invention claimed is:

1. A screw rotor comprising:
a screw portion of which an outer periphery has teeth and grooves having a helical shape and extending by a predetermined length in an axial direction, wherein
a radial cross section of at least a part of the screw portion includes a cross section of an outer surface portion forming the teeth and the grooves, a cross section of an axial center portion, a cross section of a support portion that connects an axial center side of the outer surface portion and an outer diameter side of the axial center portion, and a cross section of a hollow portion formed by the support portions adjacent to each other in a rotational direction and an axial center side inner surface of a tooth bottom or a tooth tip,
in at least the radial cross section of the screw portion, different members are continuously joined as an integral structure in a cross section of at least one of the axial center portion and the support portion and the outer surface portion, and
the hardness of the member forming the outer surface portion is higher than the hardness of the member forming the at least one of the axial center portion and the support portion.

2. The screw rotor according to claim 1,
wherein the screw rotor is a male rotor.

3. The screw rotor according to claim 1,
wherein the screw rotor is a female rotor.

4. The screw rotor according to claim 1,
wherein the screw rotor includes a set of at least one male rotor and at least one female rotor which mesh each other.

5. The screw rotor according to claim 1,
wherein the axial center portion, the support portion, the outer surface portion of the screw portion are formed as an integral structure by three-dimensional fabrication.

6. The screw rotor according to claim 1, further comprising:
an end portion in the axial direction of the screw portion,
wherein the screw portion and the end portion are formed as an integral structure by three-dimensional fabrication.

7. The screw rotor according to claim 1, further comprising:
an end portion in the axial direction of the screw portion; and
a shaft portion extending in the axial direction opposite to the end portion and the screw portion,
wherein the screw portion, the end portion, and the shaft portion are formed as an integral structure by three-dimensional fabrication.

8. A fluid machine main body comprising:
a screw rotor having:
a screw portion of which an outer periphery has teeth and grooves having a helical shape and extending by a predetermined length in an axial direction,
wherein a radial cross section of at least a part of the screw portion includes a cross section of an outer surface portion forming the teeth and the grooves, a cross section of an axial center portion, a cross section of a support portion that connects an axial center side of the outer surface portion and an outer diameter side of the axial center portion, and a cross section of a hollow portion formed by the support portions adjacent to each other in a rotational direction and an axial center side inner surface of a tooth bottom or a tooth tip, in at least the radial cross section of the screw portion, different members are continuously joined as an integral structure in a cross section of at least one of the axial center portion and the support portion and the outer surface portion, the hardness of the member forming the outer surface portion is higher than the hardness of the member forming the at least one of the axial center portion and the support portion; and a casing of the screw rotor.

9. The fluid machine main body according to claim 8, wherein the screw rotor includes a set of at least one male rotor or female rotor and another rotor meshing with the at least one male rotor or female rotor.

10. The fluid machine main body according to claim 8, wherein the axial center portion, the support portion, the outer surface portion of the screw portion are formed as an integral structure by three-dimensional fabrication.

11. The fluid machine main body according to claim 8, wherein the screw-type fluid machine main body is a gas compressor main body, an expander main body, or a liquid compressor main body.

12. The fluid machine main body according to claim 8, wherein the screw-type fluid machine main body is a gas compressor main body, and the gas compressor main body is a liquid-supply type or a liquid-free type.

* * * * *